United States Patent [19]

Ushio et al.

[11] 3,991,778

[45] Nov. 16, 1976

[54] COIN-PROCESSING DEVICE FOR SORTING AND PROCESSING VARIOUS SIZED COINS HAVING A DIAMETER-PRESETTING MEMBER AND AT THICKNESS-PRESETTING MEMBER

[75] Inventors: Masatoshi Ushio; Hisakazu Ikeuchi; Yukinobu Nakajima, all of Himeji, Japan

[73] Assignee: Glory Kogyo Kabushiki Kaisha, Hyogo, Japan

[22] Filed: Feb. 1, 1974

[21] Appl. No.: 438,775

Related U.S. Application Data

[63] Continuation of Ser. No. 355,297, April 27, 1973, abandoned, which is a continuation-in-part of Ser. No. 144,577, May 18, 1971, abandoned.

[30] Foreign Application Priority Data

May 19, 1970 Japan ..... 45-42581
Dec. 3, 1970 Japan ..... 45-106970

[52] U.S. Cl. ..... 133/8 R
[51] Int. Cl.[2] ..... G07D 9/00
[58] Field of Search ..... 133/3, 8

[56] References Cited

UNITED STATES PATENTS

| | | | |
|---|---|---|---|
| 1,921,155 | 8/1933 | Donnellan | 133/8 R |
| 3,396,737 | 8/1968 | Picollo | 133/3 R |
| 3,499,455 | 3/1970 | Uchida et al. | 133/8 R |
| 3,565,086 | 2/1971 | Zimmermann | 133/8 R |

*Primary Examiner*—Stanley H. Tollberg
*Attorney, Agent, or Firm*—Holman & Stern

[57] ABSTRACT

A coin-processing device for sorting and processing various sized coins, having a diameter-presetting member and a thickness-presetting member respectively defining the maximum width and height of a coin passageway which are actuated and preset simultaneously and adjustably by a control mechanism operated manually through a single control knob thereby to classify each kind of coin to be processed (e.g., to be counted), coins being driven along the passageway by an endless belt, which is movably supported so as to adapt itself to the thickness of each kind of coin and adapted to be adjusted at its height in response to adjustment of said control mechanism. Presetting of the diameter-manipulation member simultaneously actuates plates defining a coin entrance to the passageway thereby to preset the shape and size of the entrance to suit each kind of coin.

4 Claims, 10 Drawing Figures

7
45
86
72
71
82
84
50
87
78
76
77
75
94
91
62
61
92
65
64
70
69
83
68
88
89
90

COIN-PROCESSING DEVICE FOR SORTING AND PROCESSING VARIOUS SIZED COINS HAVING A DIAMETER-PRESETTING MEMBER AND AT THICKNESS-PRESETTING MEMBER

This is a continuation of application Ser. No. 355,297, filed Apr. 27, 1973, now abandoned, which in turn is a Continuation-in-Part Application of prior Ser. No. 144,577, filed May 18, 1971, now abandoned.

BACKGROUND

This invention relates generally to coin-handling machines and more particularly to coin-processing devices capable of sorting or classifying coins according to diameter and thickness.

More specifically, this invention relates to a new and advanced coin-processing device in a coin-handling machine wherein a diameter-discriminating means and a thickness regulating means can be simultaneously preset in accordance with the kind of coin to be processed.

In general, the diameters and thickness of coins differ with countries. In some countries such as Japan, the differences in diameters are made large, while the differences in thicknesses are made small. In other countries such as the United Kingdom, the differences in thicknesses are made large together with the differences in diameters.

In the case where coins of almost no difference in thickness are to be counted, the provision of a coin guide for constant thickness is sufficient. In the case where coins differing in diameter and thickness are to be counted, however, there is a possibility of two coins, in the case of thin coins, passing in a stacked or superimposed state through a guide for constant thickness. Such stacking gives rise to miscounting, while thick coins thus stacked are prevented from passing through. Particularly, when the difference in thickness is quite substantial, coin driving by a transferring belt cannot effectively be attained and coin sorting cannot be effected even when the means for adjusting coin diameter and thickness are provided.

OBJECTS AND SUMMARY OF THE INVENTION

It is an object of this invention to provide a coin-processing device wherein the above described difficulties are overcome, and a thickness-regulating member and a diameter-discriminating member can be simultaneously adjusted by the manipulative turning of a single control dial knob for each kind of coin to be processed.

A particularly essential object of this invention is to provide a device of the above-stated character in which a mechanism for driving coins along a coin passageway is adapted automatically to suit itself to the thickness of each kind of coins being processed by the same one control operation together with adjustment for adjusting the passage width so as to correspond to the coin diameter.

Another object of this invention is to provide a coin-processing device of the above stated character in which the size and shape of the coin entrance, through which coins are introducted into the device, are adjusted in synchronism with the diameter-discriminating member.

According to this invention, briefly summarized, there is provided a coin-processing device having a coin passageway for edgewise passage of coins therethrough, the cross-sectional dimensions of the passageway being adjustably preset by diameter-presetting and thickness-presetting members, and a drive mechanism for driving coins along the passageway, the diameter and thickness presetting members being actuated adjustably, synchronously, and simultaneously by a control mechanism operated manually through a single control knob and are thereby preset for appropriate diameter and thickness for each kind of coin to be processed.

According to this invention, furthermore, there is provided, in the above-stated device, a mechanism establishing a coin entrance leading to the coin passageway and operating to adjust the shape and size of the coin entrance for precise entry of each kind of coin to be processed.

The nature, principle, and utility of this invention will be more clearly apparent from the following detailed description with respect to preferred embodiments of the invention when read in conjunction with the accompanying drawings, in which like parts are designated by like reference numerals.

Figure 1:
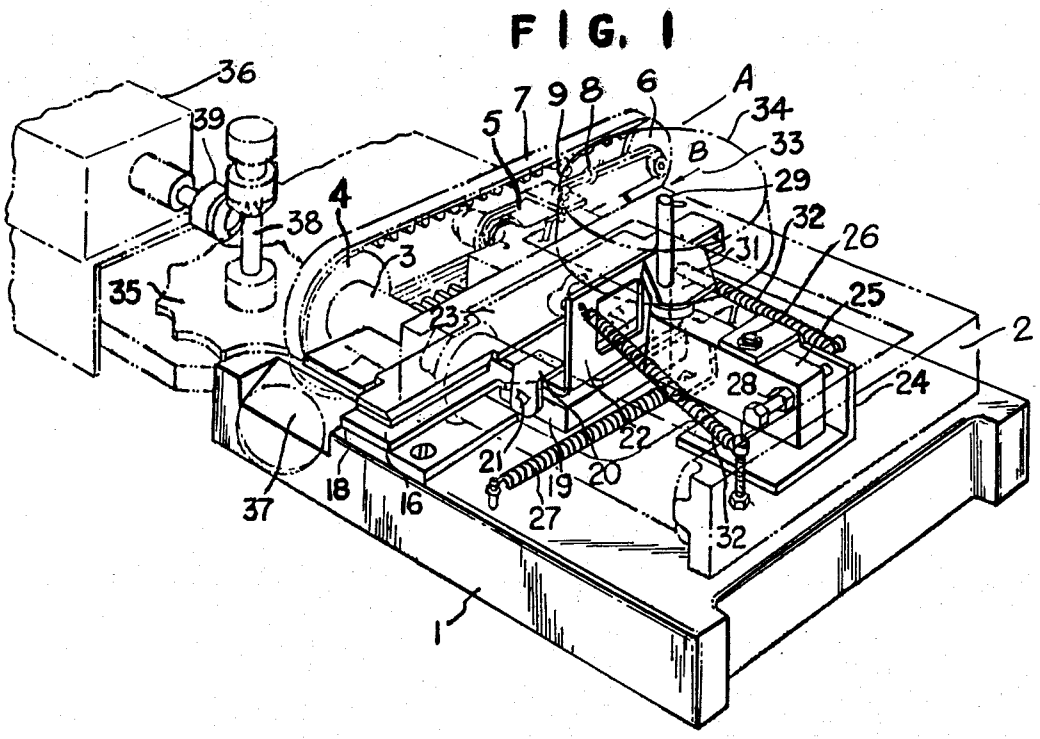
FIG. 1 is a perspective view showing the general arrangement of the essential parts of one example of the coin-processing device which is to be improved by this invention.
Figure 3:
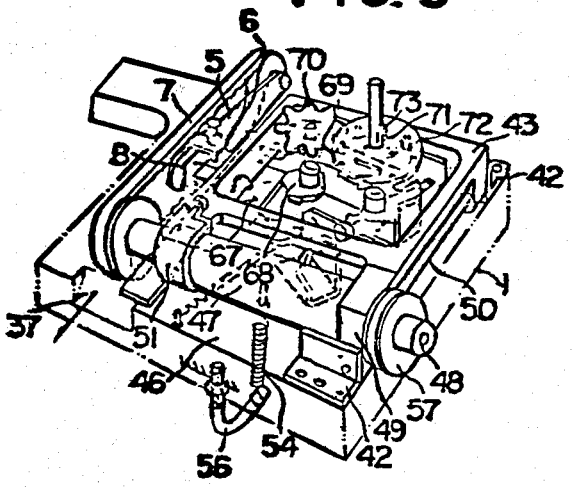
FIG. 3 is a perspective view showing the general arrangement of the essential parts of an example of the coin-processing device according to this invention.

Throughout this disclosure, directional terms such as "front" and "left" designate directions as viewed by the operator positioned in the left foreground of FIG. 1 or 3 and looking toward the device, i.e., toward the right background. That is, "front" and "rear" are respectively directions toward and away from the operator, and "left" and "right" are respectively directions toward the left and right of the operator.

DETAILED DESCRIPTION

Figure 2:
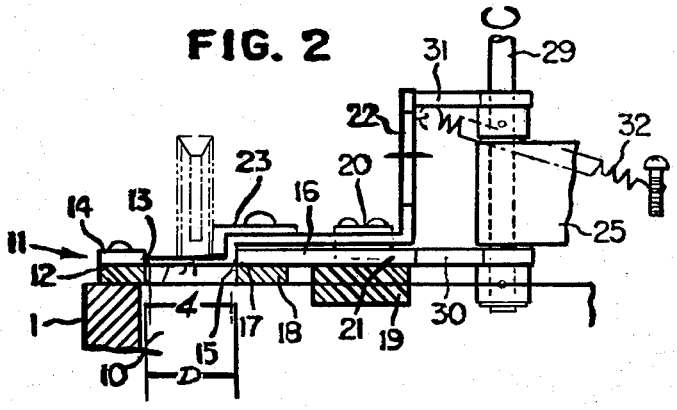
FIG. 2 is a partial sectional view, in elevation, taken along the vertical plane indicated by line II–II in FIG. 1 as viewed in the arrow direction.
Figure 7:
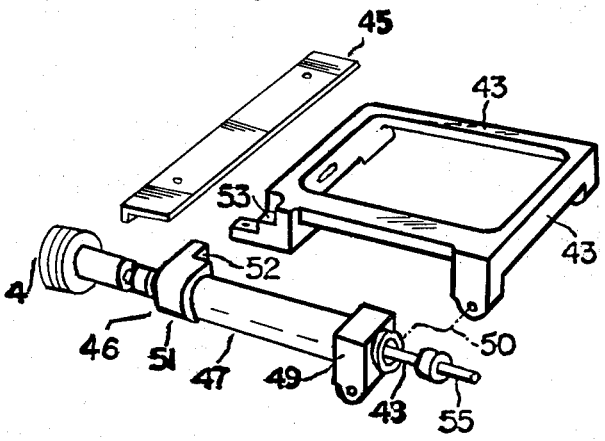
FIG. 7 is an exploded perspective view showing a movable frame, a belt-drive shaft assembly, and a thickness gauge plate in the same device.

Referring first to FIGS. 1 and 2, the coin-processing device illustrated therein is mounted on a base frame 1 fixedly supporting thereon an auxiliary frame 2. A horizontal drive shaft 3, which is rotatably supported with a left-right axial direction by the auxiliary frame 2, supports at one end thereof a driving pulley 4 fixed thereto. An endless belt 7 for coin conveying is passed around the driving pulley 4 and an idler pulley 6 rotatably supported on the rear distal end of a substantially horizontal support arm 5 pivotally supported at its front proximal end by the auxiliary frame 2. The support arm 5 is continually urged downward by a spring 8, and the lowest position thereof is adjustably set by an adjusting screw 9.

A cavity 10 is formed in the base frame 1 below the belt 7 and has an upper slot opening which is parallel to the belt and is somewhat shorter than the lower span of the belt. A fixed diameter gauge member 11 is fixed to the upper surface of the base frame 1 along the left rim of the slot opening and comprises a fixed gauge plate 12 disposed in contact with the upper rim surface of the base frame 1 and having a right edge projecting rightward slightly beyond the left rim and over the slot opening and a fixed guide plate 14 superimposed on the gauge plate 12 and having a right edge retracted or inset leftward from the right edge of the gauge plate 12, thereby forming a coin-guide ledge surface 13.

In opposed and parallel relationship to the fixed diameter gauge member 11 on the opposite side of the slot opening, there is provided a movable diameter gauge member 15 supported on the base frame 1. This movable gauge member 15 comprises a sliding guide plate 16 adapted to slide on the base frame 1 in the left-right direction, that is, perpendicularly to the belt 7, and a movable gauge plate 18 having a left edge projecting leftward slightly beyond the left edge of the sliding guide plate 16, thereby forming a coin guide ledge surface 17.

The variable gap distance D between the fixed guide plate 14 and the sliding guide plate 16 is the width of a diameter-discriminating passageway for the coins to be processed and establishes the upper limit of the coin diameter. The gap distance *d* between the fixed and movable gauge plates 12 and 18 becomes the width of a drop or escape passageway for coins of smaller diameter than the coins to be processed.

A base member 19 is fixed to the sliding guide plate 16 and pivotally supports brackets 20 through pivot pins 21. An L-shaped rockable plate 22 for establishing the upper limit of the coin thickness is fixed to the brackets 20 and supports at its left edge an inverted L-shaped thickness gauge plate 23 fixed thereto. The gap T between the lower edge of the downwardly projecting part of this gauge plate 23 and the upper surface of the aforementioned movable gauge plate 18 constitutes a restrictive passageway establishing the upper limit of the thickness of the coin to be processed.

A bracket 24 fixedly mounted on the base frame 1 pivotally supports a support arm 25 at a point near the middle part thereof by means of a vertical pivot pin 26. The support arm 25, extending substantially in the left-right direction, is continually urged in the counterclockwise direction (as viewed from above) by a tension spring 27, while movement in that direction is restricted by an adjusting screw 28, which thereby sets the anglar position of the support arm 25.

A vertical cam shaft 29 is rotatably supported on the left end of the support arm 25 and supports at its lower part a cam 30 for presetting diameter and at its upper part a cam 31 for presetting thickness. These cams 30 and 31 are fixed to the shaft 29 and lie in respective horizontal planes. The right edge of the aforemention sliding guide plate 16 and the right side of the rockable plate 22 are pressed by springs 32 against the edge surfaces of cams 30 and 31, respectively.

The cam shaft 29 extends upward and out of the case (not shown) of the device and is provided at its upper end with a dial knob 33 secured thereto. The upper (outer) dial surface of this dial knob bears around its periphery spaced-apart inscriptions such as 1, 5, 10, 50, and 100 corresponding to the denominations of the coins which can be processed.

At the front end of the aforementioned fixed guide plate 14, there is disposed a star-shaped gear 35 for coin counting lying in substantially the same horizontal plane as the fixed guide plate 14 and fixed to a vertical shaft 38, which is coupled by way of bevel gears to a counting device 36. The star-shaped gear 33 is of a known type having arcuate concavities around its periphery for successively intercepting respective coins fed by the belt 7 past the fixed guide plate 14 and sliding guide plate 16.

The diameter-presetting cam 30 and thickness-presetting cam 31 are polygons, as viewed in plan view, of similar shapes, and the edge surfaces thereof are set so that the corresponding edge surfaces of the two cams are respectively in the same plane or in parallel planes. The specific cam profiles are determined beforehand by computations based on the diameters and thicknesses of the various coins of the country in which the device is to be used and accordingly fabricated. For example, in a country where the coins used are of denominations of 5, 10, 50, and 100 monetary units, the surfaces of the two cams 30 and 31 are machined to correspond respectively to the diameters and thicknesses of these four kinds of coins.

The coin-processing device of the above described organization operates in the following manner.

When coins of 10-unit valve are to be processed, for example, the dial knob 33 is turned until the 10 inscription thereon coincides with an arrow mark on the case (not shown). Accordingly, the shaft 29 is rotated together with the cams fixed thereto. Consequently, the sliding guide plate 16 continually urged against the cam 30 is moved toward the left or right to decrease or increase the gap D, while the rockable plate 22 continually urged against the cam 31 is caused to rock or tilt about the axis of the pin 21 to decrease or increase the gap T.

Thus, when the 10 inscription is brought into coincidence with the arrow mark, the gap D is set at a value slightly greater than the diameter of the 10-unit coin. At the same time, the thickness gauge plate 23 is set at a position such that the gap T is slightly greater than the thickness of the 10-unit coin. (It will be apparent that if the gaps D and T were set at values exactly equal to the diameter and thickness of the 10-unit coin, friction would produce a high resistance and may stop the passage of the coins.)

Coins to be processed are fed at a substantially constant and ample rate by means such as a rotating coin-feed turntable (not shown), the coins being thereby fed in the arrow direction A into the coin inlet opening B indicated in FIG. 1 as they are guided by guide means as described hereinafter with respect to a third embodiment of this invention. During this feeding step, coins of greater diameter or thickness than the 10-unit coin as, for example, 50-unit and 100-unit coins, are prevented from entering the inlet opening B and pass by, while 10-unit coins and coins of smaller diameter and thickness than 10-unit coins as, for example, 1-unit and 5-unit coins, enter and advance into the inlet opening and coin passageway.

The coins thus advancing are advanced further by the belt 7. Then, as the coins pass over the upper slot opening of the cavity 10 below the belt 7, coins of smaller diameter than the 10-unit coin, that is, 1-unit and 5-unit coins of diameters less than the gap *d* between the fixed and movable gauge plates 12 and 18, drop through the slot opening. Consequently, only 10-unit coins sliding along the coin guide surfaces 13 and 17 are fed further by the belt 7 and are intercepted and counted by the star-shaped gear 35, finally dropping out through an outlet 37.

Corrective adjustments of the coin-classification passageway made necessary by wear and assembly errors of various parts are effected by turning the adjusting screws 28 thereby to rotate the support arm 25 about the vertical pivot pin and thereby to vary the position of the cam shaft 29. The force with which the belt 7 presses against the coins in feeding them is adjusted by turning the adjusting screw 9 thereby to rotate the support arm 5 about its pivot and thereby to vary the height of the idler pulley 6.

According to the above-mentioned coin-processing device wherein, by a mere one-motion rotation of a cam shaft, a coin diameter gauging member and a thickness gauging member can be simultaneously adjusted, whereby the operation is simple, and high work efficiency is afforded.

As mentioned briefly hereinbefore, the diference between the thicknesses of the various coins are very small in some countries such as Japan. In other countries such as the United Kingdom, however, the differences in thicknesses are quite substantial. In such cases, coin-driving by a transferring belt cannot be effectively attained and coin sorting cannot be effected even when the means for adjusting the above-mentioned coin diameter and coin thickness are provided.

According to the present invention, such disadvantage has been eliminated by providing means for adjusting the height of the working lower surface of the coin-driving belt, with the means being adapted to be controlled in response to and simultaneous with the operation of the means for adjusting the passageway and coin entrance so as to conform with the diameter and thickness of the coins to be processed. One example of the invention will be described hereinafter in connection with FIGS. 3 – 7.

The device shown in FIG. 3 has a base frame 1, on which are mounted spaced-apart brackets 42, 42 supporting a horizontal pivot shaft 50. A movable frame 43 of rectangular shape in plan view is pivotally supported along its right side on the pivot shaft 50 and supports along its left side and on the lower surface thereof a thickness gauge plate 45 detechably secured thereto and projecting leftward over the central part of a coin passageway terminating at the coin outlet 37 and having a configuration similar to that of the preceding structure. The thickness gauge plate 45 determines the upper limit of the coin passageway in the thickness direction and, at the same time, functions as a coin guide.

A belt-driving mechanism 46 is pivotally supported with left-right orientation on the movable frame 43 and comprises a hollow shaft support 47 and a rotating drive shaft 48 passing coaxially therethrough and rotatably supported thereby. The right end of the hollow shaft support 47 is in the form of a boss 49, which is pivotally supported on the base frame 1 by the above mentioned pivot shaft 50. The left end of the shaft support 47 is provided with an enlarged part 51 having a projection 52 resting on a ledge or shoulder 53 formed on the front left corner of the movable frame 43. The shaft support 47 is urged downward by a constant force exerted by a tension spring 54 anchored to an arm 56 rigidly fixed to the base frame 1.

The right end of the above mentioned drive shaft 48 is coupled by way of a driven pulley 57 fixed thereto a motive power means (not shown). A driving pulley 4 is fixed to the left end of the drive shaft 48 and constitutes a member of a coin driving mechanism which is similar to that in the preceding example, that is, comprising the driving pulley 4, a support arm 5 pivotally supported at its front end on the movable frame 43, a spring 8 urging the support 5 downward, an idler pulley 6 rotatably supported on the rear distal end of the arm 5, and an endless belt 7 passed around the driving and idler pulleys 4 and 6.

Figure 4:
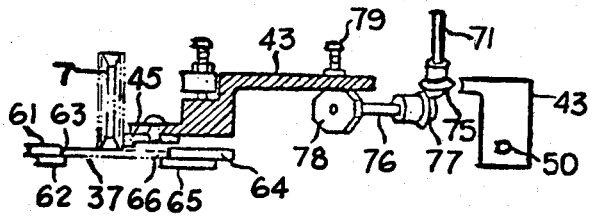
FIG. 4 is a diagrammatic elevational view, with parts cut away, showing the essential elements of a mechanism for presetting coin thickness in the device shown in FIG. 3.
Figure 5:
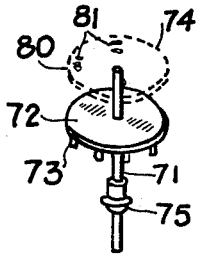
FIG. 5 is a perspective view showing the essential elements of a mechanicm for controlling the presetting of diameter and thickness in the same device.
Figure 6:
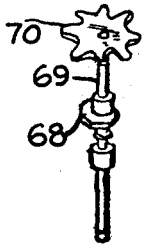
FIG. 6 is a perspective view showing the integral combination of a gear wheel, shaft, and cam for presetting the coin diameter in the device.
Figure 8:
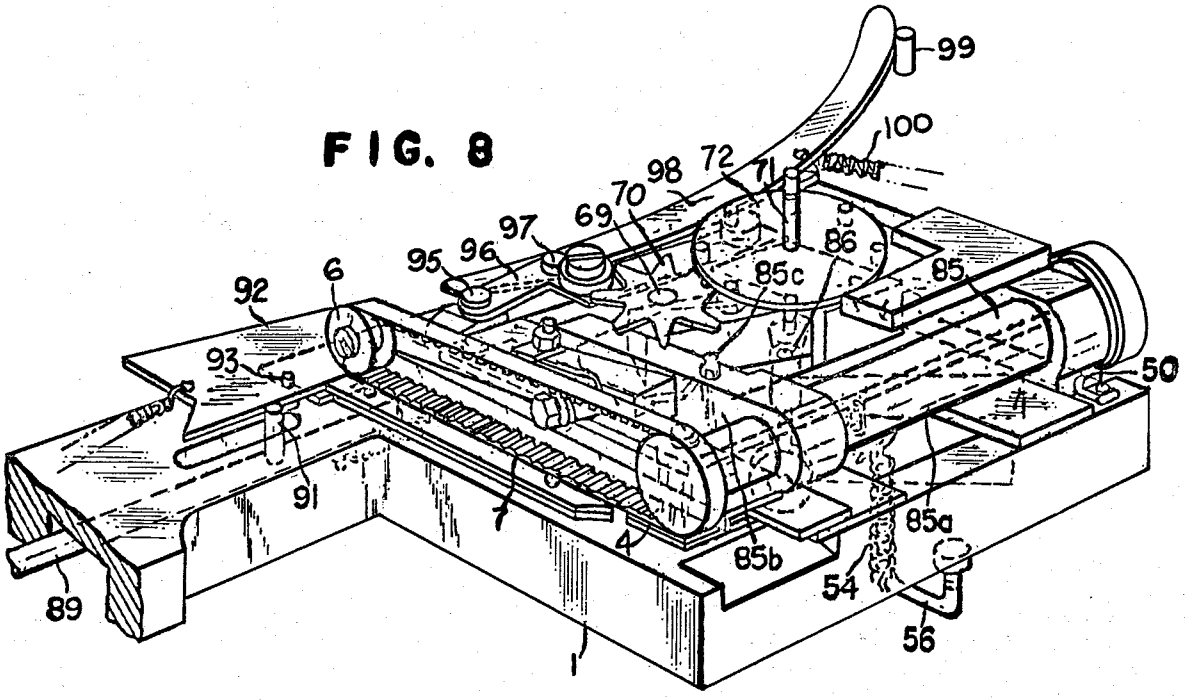
FIG. 8 is a perspective view showing the general arrangement of the essential parts of another example of the coin-processing device according to this invention.
Figures 9, 11:
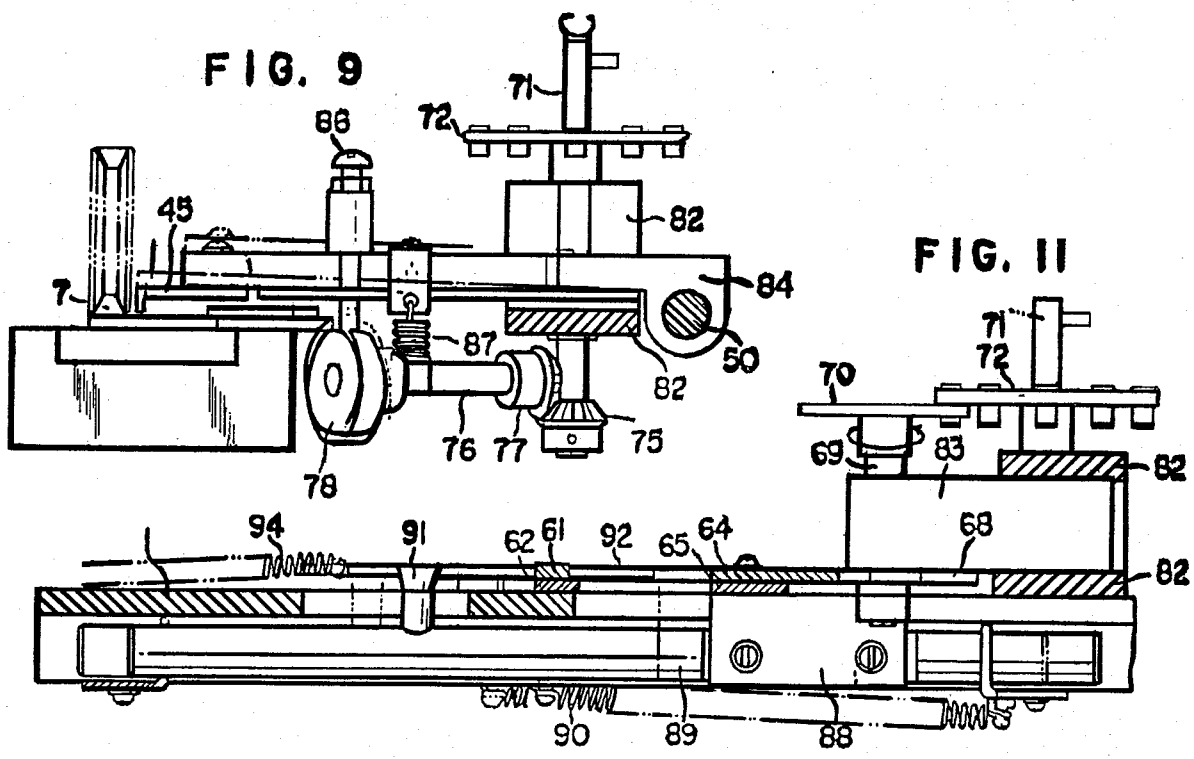
FIG. 9 is a front elevation, with parts cut away and some parts shown in vertical section, showing the mechanism for presetting coin thickness in the device shown in FIG. 8.
FIGS. 10 and 11 are respectively a plan view and an elevation, with parts cut away and some parts deleted, showing the mechanisms for presetting the coin diameter and the size and shape of the coin entrance.
Figure 10:
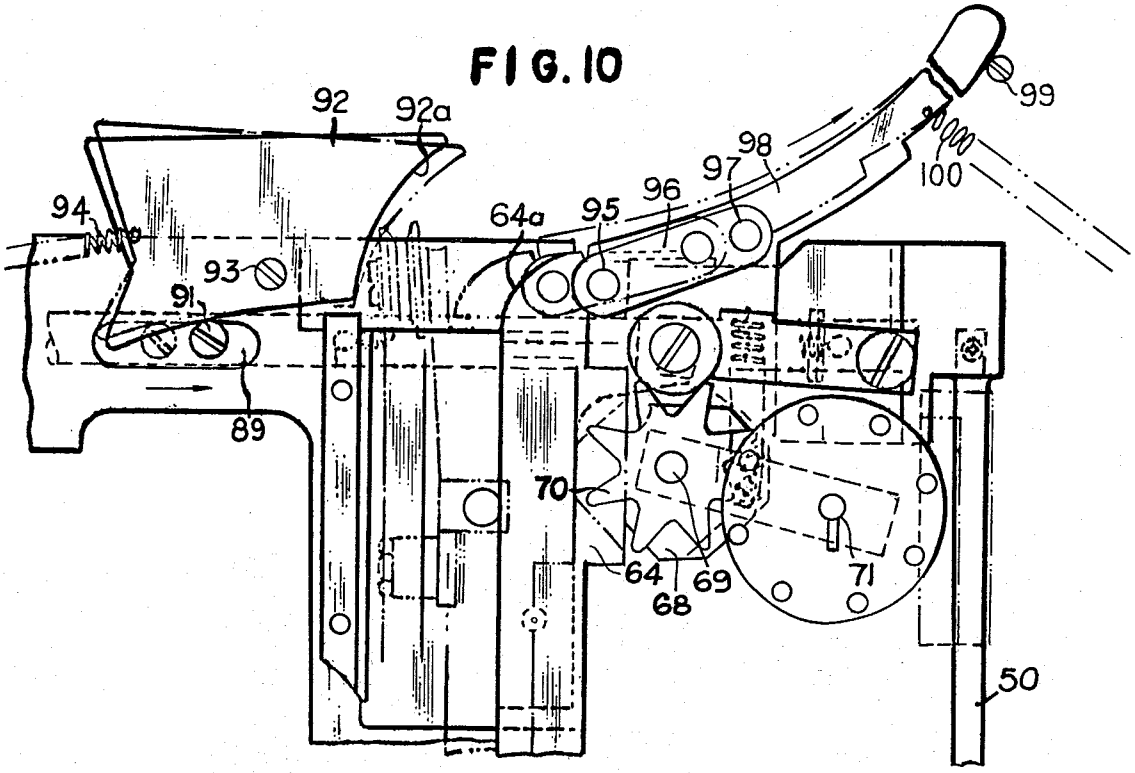

The coin passageway below the belt 7 is defined in its horizontal, left-right direction by left (fixed) and right (movable) gauge members similar to those of the preceding example. That is, as shown in FIG. 4, these gauge members comprise a fixed guide plate 61 and a fixed gauge plate 62 integrally constituting the left gauge member and having a coin guide ledge or shoulder 63 and a sliding guide plate 64 and a movable gauge plate 65 integrally constituting the right gauge member and having a coin guide ledge 66.

The right edge of the sliding guide plate 64 extends rightward as a projection 67, as shown in FIG. 3, having a right edge surface in contact with a diameter-presetting cam 68. This cam 68 is fixed to a vertical cam shaft 69 fixedly supporting at its upper part a gear wheel 70, which is meshed with pins 73 imbedded at their root parts in a pin wheel 72 fixed to a vertical shaft 71 at a point intermediate between its upper and lower ends. A dial knob 74 is fixed to the upper end of the shaft 71.

The diameter-presetting cam 68 is formed in the shape of a polygon having a number of sides in accordance with the diameters of the different coins to be processed. That is, for example, the cam 68 has a shape such as to move the sliding guide plate 64 to positions for presetting the width of the coin passageway at values corresponding to the diameters of 100-unit, 50-unit, and 10-unit coins.

A bevel gear 75 is fixed to the lower end of the vertical shaft 71 and is meshed with a bevel gear 77 fixed to one end of a horizontal shaft 76 rotatably supported on the movable frame 43. To the other end of the shaft 76, there is fixed a thickness-presetting cam 78 for adjusting the height of the thickness gauge plate 45 and thereby presetting the thickness gap in correspondence with the operation of the diameter-presetting cam 68. The peripheral cam surface of this cam 78 is in contact with and followed by the lower tip of a vertical adjusting screw 79 in screw engagement with a part of the movable frame 43.

Thus, the diameter-presetting cam 68 operates to move the sliding guide plate 64 and movable gauge plate 65 in a horizontal direction for presetting the width of the coin passageway in accordance with the kind of coin to be processed, while the thickness-presetting cam 78 operates to move the thickness gauge plate 45 in the vertical direction thereby to preset the height of the coin passageway at a value corresponding to the thickness of the coin to be processed. These presetting cams 68 and 78 are fabricated beforehand in accordance with the various kinds of coins of the country in which the device is to be used.

The top face of the dial knob bears around its periphery inscriptions 81 designating the denominations of the coins which can be processed, corresponding to the angular positions of the cams 68 and 78. These denomination inscriptions are read in conjunction with an indicating mark 80 on the outer case (not shown) of the device.

The coin-processing device constituting an example of the invention of the above described organization operates in the following manner.

First, the dial knob 74 is turned to bring the inscribed indication 81 of the kind of coin to be processed into coincidence with the indicating mark 80. As a result, the shaft 71, to which the knob 74 is fixed, rotates, whereupon the pin wheel 72 also rotates to rotate the gear wheel 70, whereby the shaft 69 and the diameter-presetting cam 68 rotate. Consequently, the sliding guide plate 64 in contact with this cam 68 is caused to move to the right or left together with the movable gauge plate 65 to preset the width of the coin passageway at a value corresponding to the diameter of the coin to be processed.

At the same time, the bevel gear 75 fixed to the lower end of the shaft 71 also rotates to drive the bevel gear 77 meshed therewith and the shaft 76, whereby the thickness-presetting cam 78 rotates. Consequently, the adjusting screw 79 following the cam 78 is moved in a substantially vertical direction, whereby the movable frame 43 is caused to pivot about the horizontal shaft 50. As a result, the thickness gauge plate 45 affixed to the left side of the movable frame 43 at the lower surface thereof is moved up or down to preset the height of the lowest part of the gauge plate 45 above the plane passing through the ledges 63 and 66 to a value corresponding to the thickness of the coin to be processed.

In actual practice, both the preset width and height of the coin passageway are made slightly larger than the diameter and thickness of the coin to be processed so as to prevent excessive resistance due to friction to movement of the coins through the coin passageway.

The coins of the denomination to be processed are fed into the rear end of the coin passageway in the direction of the arrow indicated in FIG. 3, are driven by the belt 7 through the coin passageway, and are discharged at the outlet 37 to a process step such as a known wrapping step, for example.

Since the lower working surface of the belt 7 is set at a level lower than the upper surfaces of coins passing through the passageway, the flow of the coins forces upward the shaft 48 of the belt driving pulley 4. Consequently, the hollow shaft support 47 pivots slightly upward about the shaft 50, whereby the projection 52 separates from the ledge 53 of the movable frame 43, and the belt, in a freely floating state, presses down with a larger yet constant force on the coins under the action of the spring 54 as the coins are conveyed by the driving force of the belt 7 along the ledges 63 and 66.

During this operation, any coin which is of a diameter smaller than the diameter preset in the above described manner is not caught on the ledges 63 and 66 but drops through the gap therebetween. Any coin of a diameter or thickness greater than that preset in the above described manner is prevented from entering the coin passageway.

Thus, as described above with respect the second example of this invention, it is possible to adjust the width and height of the coin passageway to correspond to the diameter and thickness of coins of a kind to be processed by merely rotating the single dial knob 74. Accordingly, the operative manipulation is rapid and simple.

Furthermore, independently of the height thus preset, the coin-feeding belt 7 can be raised or lowered in accordance with the thickness of the coins passing through. Accordingly, it is possible to press downward on the coins with a constant, large force, whereby the coin driving operation can be carried out rapidly and positively.

In a second embodiment of the invention as illustrated in FIGS. 8 through 11, a thickness gauge plate 45 similar in shape and function to that in the preceding example is fixed to the lower surface of a movable frame 84 at the left side edge thereof. The frame 84 is pivotally supported along its right side on a base frame 1 by a horizontal pivot shaft 50 and is urged downward, i.e., to pivotally rotate in the counterclockwise direction as viewed in FIG. 9, by a tension spring 87 secured at its upper end to the frame 84 at a point intermediate between the left and right sides thereof and at its lower end to a part of the base frame 1.

A vertical adjusting screw 86 in screw engagement with a part of the movable frame 84 near the spring 87 has a lower end resting on a thickness-presetting cam 78 similar to cam 78 in the preceding example and similarly rotated by a vertical control shaft 71 through bevel gears 75 and 77 and a horizontal shaft 76. The vertical shaft 72 is rotatably supported on a bridge structure 82 integral with the base frame 1.

The vertical control shaft 71, which is rotationally manipulated by means of a dial knob (not shown) fixed to its upper end similarly as in the preceding example, also supports a pin wheel 72 fixed thereto. The pin wheel 72 is meshed with a gear wheel 70 fixed to the upper end of a vertical cam shaft 69, which is rotatably supported by a support arm 83 supported in turn by the bridge structure. A diameter-presetting cam 68 is fixed to the lower end of the cam shaft 69 and is followed by the right edge of a sliding guide plate 64 similarly as in the preceding example.

A support structure 85 for supporting the belt-driving mechanism is pivotally supported at its right side on the base frame 1 by the pivot shaft 50. This support structure has a hollow shaft support **85*a* similar to the support 47 of the preceding example and a support arm 85*b* for supporting the arm 5 for supporting the idler pulley 6 of the coin-driving belt 7 driven by a driving pulley 4,** these parts of the belt-driving mechanism being similar in organization to those designated by the same reference numerals in the preceding example.

The support structure 85 is urged downward by a tension spring 54 secured at its upper end to the hollow shaft support **85*a* and at its lower end to an arm 56 rigidly fixed to the base frame 1. The resulting counterclockwise moment (as viewed from front to rear) about the pivot shaft 50 due to this spring force, together with the moment due to gravitational force, applied to the support structure 85 is transmitted through an adjusting screw 85***c* to the movable frame 84. The adjusting screw 85*c* is in screw engagement with the support arm 85*b* and is in contact at its lower end with the upper surface of the movable frame 84. The lower limit of the position of the support structure 83 relative to the movable frame 84 is thus adjustably set.

In the instant second example, furthermore, a bracket 88 is fixed at one flange thereof to the lower surface of a movable gauge plate 65 fixed in turn to the sliding guide plate 64. The other flange of the bracket 88 is fixed to a horizontal push-pull rod 89 slidably supported in the left-right direction on the base frame 1 and urged toward the right by a tension spring 90 fixed at its left end to the rod 89 and at its right end to the base frame 1. A stud pin 91, imbeddedly fixed at its lower end to the push-pull rod 89 extends upward through a slot in the base frame 1.

The upper part of the stud pin 91 is in contact with a cam edge surface of a coin entrance guide plate 92 pivoted on a pivot pin 93 fixed to and extending upward from the base frame 1 at a point on its rear side. The guide plate 92 is urged to pivot into continual contact with the stud pin 91 by a tension spring 94 and has along its right side a fair-curve of which the concave edge 92*a* forming the left boundary of a coin entrance to the upstream end (rear end) of the aforementioned coin passageway below the belt 7.

The sliding guide plate 64 has along its rear end a fair-curve, convex, edge 64*a* forming the right boundary of the above mentioned coin entrance. On the rear end of the guide plate 64 at a point to the right of the convex edge 64*a*, there is provided a stud pin 95 imbeddedly fixed at its lower end to the guide plate 64. A link member 96 is rotatably engaged at one end thereof with the stud pin 95 and at the other end with a stud pin fixed to a curved guide member 98.

This guide member 98 has a fair-curve concave edge facing toward the rear left direction and a left tip fitting loosely into a stepped part immediately to the right of the above mentioned convex edge 64*a* of the guide plate 64, whereby the concave edge of the guide member 98 smoothly joins the convex edge 64*a* to form a substantially continuous fair curve for guiding coins on a coin-feed turntable (not shown) to the coin entrance. The guide member is urged toward the front right direction and held in sliding contact with a stop pin 99 by a tension spring, the stop pin 99 being fixed to a stationary part of the coin-processing device or of the coin-handling machine.

The coin-process device of the above described organization constituting the second example of the invention operates in the following manner.

The operation of presetting the coin thickness and diameter by the thickness-presetting cam 78 and the diameter-presetting cam 68 actuated by the turning of a single dial knob, similar to the dial knob 33 is FIGS. 1 and 2, is the same as that in the preceding example. The lifting of the support structure 85, together with the belt 7 and its drive mechanism, off the movable frame 84 due to coins entering the coin passageway is also similar to that described with respect to the preceding example.

Since the aforedescribed bracket 88 is fixed to the sliding guide plate 64 and to the push-pull rod 89, a leftward movement of the guide plate 64 caused by the diameter-presetting cam 69 to decrease the width of the coin passageway causes the rod 89 to move leftward. Consequently, the stud pin 91 also moves leftward and, acting on the cam edge surface of the entrance guide plate 92, rotates this guide plate in the clockwise direction, whereby the concave edge 92*a* thereof is tilted rightward to narrow the coin entrance gap.

At the same time, the same leftward movement of the guide plate 64 causes its convex edge 64*a* to move leftward thereby to narrow the coin entrance gap still further. The guide member 98 is causes by the link member 96 to accompany the guide plate 64 in this leftward movement, whereby a continuous, smooth guide is presented to the coins.

A rightward movement of the sliding guide plate 64 to increase the width of the coin passageway causes a reversal of the above described movement, the spring 90 operating to return the rod 89 and all parts connected thereto toward the right.

Thus, in synchronism with the operations of the sliding guide plate 64 and the thickness gauge plate 45 to increase and decrease the width and height of the coin passageway, the coin entrance gap is broadened and narrowed by the leftward and rightward movements of the concave edge 92*a* of the entrance guide plate 92 and the rightward and leftward movements of the convex edge 64*a* of the sliding guide plate 64.

The configurations of the edges 92*a* and 64*a* forming the boundaries of the coin entrance and that of the guide member 98, as well as the actions of the related parts are so designed as to form the optimum coin entrance for each of the various kinds of coins to be processed. Accordingly, when the device is preset by the turning of the dial knob for operation with any one kind of coin, the coins fed by a coin-feed turntable are caught and guided by the guide member 98 and successively and smoothly enter the coin entrance without jamming. Any coins of diameter larger than the preset diameter cannot enter the coin entrance and are swept past the guide plate 92 toward the left by the action of the turntable. Coins of diameters smaller than the preset diameter enter the coin entrance but drop through the escape hole in the floor of the coin passageway.

What is claimed is:

1. A coin-processing device for sorting coins of different sizes, comprising:

an adjustable coin passageway for edgewise passage of coins therethrough;

a diameter-presetting member for adjustably presetting a cross-section of said passageway;

first control means including a first turnable cam member adapted for positioning said diameter-presetting member to a position corresponding to the coin diameter;

coin drive-transferring means for driving coins charged into said passageway along the passageway;

a movably mounted frame member;

a driving shaft for driving said coin drive-transferring means and supported by said frame member;

second control means including a second turnable cam member adapted for positioning said coin drive-transferring means to a position corresponding to the denomination of the coins to be processed; and a single manual coin selecting section including a coin selecting shaft for selecting a coin of a particular kind to be processed, and said first and second cam members being coupled with said selecting shaft and having cam surfaces corresponding respectively to differing kinds of coins to be processed, whereby when said shaft is rotated by a predetermined angle for selecting a coin of a particular kind to be processed, said first and second cam members are rotated by a predetermined angle thereby to cause engagement of said cam surfaces with said diameter-presetting member and said frame member, thus causing presetting of said diameter-presetting member and said coin drive transferring means to respective positions corresponding to the diameter and thickness of said coin of a particular kind.

2. A coin-processing device as claimed in claim 1, which further comprises a thickness-presetting member for adjustably presetting a cross-section of the coin passageway, said thickness-presetting member being engaged with said second turnable cam member, whereby engagement of the cam surfaces of the cam members with said diameter-presetting member, said frame member, and said thickness-presetting member is caused by a predetermined-angle-rotation of said selecting shaft thereby to preset said diameter-presetting member, said coin drive-transferring means, and said thickness presetting member to respective positions corresponding to the diameter and thickness of the selected coin of a particular kind to be processed.

3. A coin-processing device, comprising:

an adjustable coin passageway for edgewise passage of coins therethrough;

a diameter-presetting member for adjustably presetting a cross-section of said passageway;

a first turnable cam member engaged with said diameter-presetting member thereby to preset said cross-section appropriately for the diameter of each coin of a particular kind to be processed;

a thickness-presetting member for adjustably presetting a cross-section commensurate with the thickness of each kind of coin to be processed;

a second turnable cam member engagable with said thickness-presetting member thereto to preset said thickness-presetting member for the thickness of each kind of coin to be processed;

drive means for driving coins along the passageway, said drive means, during operation, automatically adapting itself to the thickness of each kind of coin being processed independently of the preset position of said thickness-presetting member;

a single coin selecting shaft for selecting the kind of coin to be processed, said first and second cam members being coupled with said selecting shaft and having cam surfaces corresponding respectively to the differing kinds of coins to be processed, thereby to cause engagement of selected cam surfaces of said cam members with said diameter-presetting member and said thickness-presetting member when said selected shaft is turned so as to preset said members at their positions corresponding to a particular kind of coin selected to be processed, said coin passageway being provided with a coin entrance defined by at least one movable guide member adjustably actuated by a control mechanism in synchronism with said presetting members thereby to adjust the configuration and dimensions of said coin entrance to correspond to the kind of coin to be processed, one side boundary of said coin entrance being variably defined by a concave edge surface of a pivotally supported guide plate adjustably actuated through a movement transmitting mechanism by the diameter-presetting member, and another side boundary of said coin entrance being variably defined by a convex edge surface movable integrally with said diameter-presetting member to move integrally therewith and having a guide surface contiguously forming a fair curve with said convex edge surface thereby to guide coins smoothly to the coin entrance.

4. A coin-processing device as claimed in claim 3, in which said control means comprises first and second cams driven by a coin selected shaft for actuating said diameter and said thickness-presetting members, respectively, and said coin drive means comprises a driving pulley driven by motive power means, an idler pulley spaced apart from said driving pulley, and an endless belt passed around said pulleys and having an outer surface for direct-contact driving of coins in the coin passageway, said coin passageway being disposed horizontally on a base frame, said thickness presetting member being fixed to a first support structure pivotally supported on said base frame by a horizontal pivot member and positioned by an adjusting screw thread-engaged therewith and urged against said second cam by a spring, and said driving pulley and idler pulley are rotatably supported on a second support structure pivotally supported on said base frame by a horizontal pivot member and urged downward by a spring force against the upper surface of the first support structure, whereby the second support structure moves pivotally together with the first support structure except when the second support structure is forced upward by the thickness of a coin to left free of the first support structure, overcoming said spring force.

* * * * *